United States Patent [19]

Dunn

[11] Patent Number: 4,637,556

[45] Date of Patent: Jan. 20, 1987

[54] HIGH EFFICIENCY SEPARATOR SYSTEM

[75] Inventor: Mark R. Dunn, Evanston, Ill.

[73] Assignee: Combustion Engineering, Inc., Windsor, Conn.

[21] Appl. No.: 759,389

[22] Filed: Jul. 26, 1985

[51] Int. Cl.[4] ..... B02C 23/34

[52] U.S. Cl. ..... 241/48; 241/79.1

[58] Field of Search ..... 209/139 A, 144, 145, 209/138, 148, 150, 139 R; 241/79.1, 24, 57, 80, 48, 52, 61, 97

[56] References Cited

U.S. PATENT DOCUMENTS

| | | | |
|---|---|---|---|
| 2,236,548 | 4/1941 | Prouty | 241/48 X |
| 2,354,312 | 7/1944 | Harlow | 241/48 |
| 3,013,734 | 12/1961 | Hischmann | 209/139 A |
| 4,059,507 | 11/1977 | Nobuo | 209/139 A |

*Primary Examiner*—Mark Rosenbaum

*Attorney, Agent, or Firm*—Arthur E. Fournier, Jr.

[57] ABSTRACT

A high efficiency separator system (10) operative for processing material that includes grinding means (12), high efficiency separator means (14), dust collector measn (16) and fan means (18) all of which are interconnected in a predefined flow path. In accord with the nature of the construction of the subject high efficiency separator system (10), the grinding means (12) is connected to the high efficiency separator means (14) and the high efficiency separator means (14) in turn is interconnected to both the grinding means (12) and the dust collector means (16) whereby the mode of operation of the subject system (10) is such that the material supplied to the system (10) is ground in the grinding means (12), is classified on the basis of particle size in the high efficiency separator means (14), and ultimately is discharged from the dust collector means (16) in the form of finished product which consists of material that has been ground to a predetermined particle size.

6 Claims, 3 Drawing Figures

HIGH EFFICIENCY SEPARATOR SYSTEM

BACKGROUND OF THE INVENTION

This invention relates to systems of the type that are operative to grind material as well as to separate the ground material into a finished product containing particles which are of a predetermined size, and in particular to a high efficiency separator system which embodies a high efficiency mechanical air separator.

For purposes of the discussion that follows hereinafter, systems of the type to which the present invention is directed will be viewed as being composed essentially of two major operating components; namely, a grinding device and a separator device. Regarding first the grinding device, it has long been known in the prior art to provide apparatus which are employable for purposes of effectuating the grinding of materials. To this end, the prior art is replete with examples of various types of apparatus that have been used heretofore to effect the grinding of a multiplicity of different kinds of materials. In this regard, in many instances discernible differences of a structural nature can be found to exist between individual ones of the aforesaid apparatus. The existence of such differences is, in turn, attributable for the most part to the diverse functional requirements that are associated with the specific applications in which such apparatus are designed to be employed. For instance, in the selection of the particular type of apparatus that is to be utilized for a specific application one of the principal factors to which consideration must be given is that of the nature of the material that is to be ground in the application. Another factor to which consideration must be given is that of the fineness to which it is desired to grind the material.

Turning next to a consideration of separator devices, as the name given thereto implies, the function of a separator device is to effectuate in some preestablished fashion a separation of material which is made to enter the separator device. Apparatus have long been known to be available in the prior art which are suitable for use for such a purpose. By way of exemplification in this regard, one such apparatus is that known to those skilled in the art of separator devices as a mechanical air separator. Applicant's assignee is a manufacturer of such mechanical air separators.

With further reference to the mechanical air separators manufactured by applicant's assignee, in accordance with the nature of the construction that such mechanical air separators have heretofore embodied the material which is to undergo separation enters a hollow shaft, or center feed pipe, at the top of the mechanical air separator and under the influence of gravity drops upon a rotating distributor plate which is suitably positioned therebelow. This distributor plate disperses the material into the upward sweep of circulating air which is suitably developed by a fan located in the top chamber of the mechanical air separator. One or more whizzer blades are operative to bring about a centrifugal motion of the air and the material. The effect thereof in turn is to concentrate the oversize material along the inner cone of the mechanical air separator whereupon the oversized material passes out of a tailings spout which is located at the bottom of the mechanical air separator. Meanwhile, the air and powdered material of the desired fineness moves through the fan and is delivered into the outer cone chamber of the mechanical air separator whereupon the fines are discharged from the mechanical air separator as finished product. The air, after the fines have been released in the outer cone, returns through the deflector ports with which the mechanical air separator is provided to the inner cone thereby establishing a continuous circulation of the flow of air.

Mechanical air separators of the type that have heretofore been manufactured by applicant's assignee and which operate in the manner that has been described hereinabove have been found to be suitable for use for many different purposes. By way of exemplification and not limitation, such mechanical air separators have been successfully employed in closed circuit grinding operations for classifying, and drying where desired, raw mix, and classifying, and cooling, finished cement; for producing limestone sand to meet close specifications of granular sand material to be used in bituminous concrete, mortar, as an aggregate and many other uses; for making fine, uniform cake mixes and for the production of protein-enriched grades of flour; for producing a high fineness, uniformly classified, hydrated lime for chemical and spray purposes; for classifying numerous food products including sugar, cocoa, milk powder, food mixtures with various ingredients, corn starch and wheat starch, and soya bean meal; in applications where manufactured chemicals are required in closely sized form, i.e., for making the various grades ranging from extremely fine to the granular dustfree gradations of such chemicals as soda ash and sodium phosphate; in the beneficiation of certain materials such as talc, kaolin and clays, and phosphate rock for purposes of removing therefrom impurities in the form of silica, flint and other foreign materials; for classifying metal powders consisting of copper, bronze, iron and various alloys and for de-dusting of seacoal for foundry facing use, etc.

For purposes of its use in applications of the sort enumerated above, it is possible to combine the aforereferenced mechanical air separator with a variety of different forms of grinding devices such as ball mills, tube mills, compartment mills, etc. Furthermore, when so employed in combination with a grinding device, the mechanical air separator may be connected either in closed circuit relation or in open circuit relation therewith. When operated in closed circuit combination with a grinding device, the mechanical air separator is designed to skim off the fines as fast as they are produced such that the grinding device works only on fresh material without wasting power. The tailings from the mechanical air separator, however, are discharged back to the grinding device for further reduction. After being reground in the grinding device, the reground material is returned to the mechanical air separator along with the feed that is being supplied thereto so that a constant circulating load is established between the grinding device and the mechanical air separator. In contradistinction to the manner in which the mechanical air separator is made to interact with the grinding device when the former is connected in closed circuit relation therewith, when the mechanical air separator is connected in open circuit relation with the grinding device the ground material is supplied from the grinding device in the form of feed to the mechanical air separator but the tailings from the mechanical air separator are not recirculated to the grinding device for further reduction in the grinding device.

One application in which particular use has been made of mechanical air separators is that relating to the grinding and classifying of cement wherein the mechanical air separator has been combined with a grinding device so as to form a closed circuit therewith. However, notwithstanding the extent to which mechanical air separators have been employed heretofore for this purpose the efficiency of mechanical air separators has for many years nevertheless been a subject of considerable concern. Moreover, much of this concern has come from the cement industry itself with respect to the finish cement grinding circuit. In the past, though, measurement of the grinding circuit's circulating load, recovery and efficiency was usually based on a single particle size measurement of the feed, fines and tailings. Also, the methods normally employed for this purpose have been subject to large errors. Though some analysis has been done utilizing sub-sieve particle size equipment, it has been limited by the particle size range and time requirements of the analyzers. This had made extensive study of the performance of mechanical air separators impractical.

Very recently, however, particle size analyzers have become available that can analyze samples very quickly. They also provide a complete particle size distribution for the sample. This in turn has permitted an extensive study of the performance of mechanical air separators to be undertaken at a reasonable cost. In addition, it has permitted results to be based on the complete particle size distribution and has enabled errors to be recognized.

As regards the matter of efficiency, the higher the efficiency of a mechanical air separator, the closer the fractional recovery comes to 100% at the finest particle sizes. The term fractional recovery refers to the percentage of the material of a given particle size or between two particle sizes which is present in the feed to the mechanical air separator and which is recovered in the finished product from the mechanical air separator. When fractional recovery is plotted against particle size, this plot is referred to as a "Tromp Curve". A "Tromp Curve" is one way of measuring the efficiency of a mechanical air separator. In this regard, a perfect mechanical air separator, i.e., one having an efficiency of 100%, would have a "Tromp Curve" that would be a vertical line at the "cut point" particle size. That is, everything in the finished product would be finer than this cut point particle size and everything in the tailings would be coarser.

A mechanical air separator's inability to attain 100% fractional recovery is referred to as bypassing. More specifically, bypassing is defined as being the difference between a numerical value of 100% and the amount of fractional recovery that is actually attained at the finest particle sizes. Based on test results, it has been determined that mechanical air separators with low circulating loads have the least bypass, i.e., are the most efficient, whereas mechanical air separators with high circulating loads have the greatest bypass, i.e., are the least efficient.

Bypassing is alleged to be caused by one or more of the following three events. One of these is the internal recirculation of fines. A second is the inadequate dispersion of the feed in the air prior to the feed reaching the classifying zone of the mechanical air separator. The third is the existence of an excessive material/air ratio which has the effect of causing interference between particles within the classifying zone of the mechanical air separator.

For a number of years, the cyclone separator has been marketed in an attempt to alleviate the first of the three causes of bypassing that has been enumerated above. Unfortunately, however, the cyclone separators that have been marketed utilize relatively low efficiency cyclones, i.e., cyclones having an efficiency of between 88 and 92%, and thus the effect thereof is that fines are still recirculated to the separator. In addition, such cyclone separators have not addressed the second cause of bypassing that has been enumerated above. As such, the rather small improvement in efficiency achieved with the cyclone type separator generally has not justified the high capital cost of such cyclone separators. It is known that in some instances repeated washings of the tailings has been undertaken in the cyclone separator in an attempt to remove the fines from the tailings. The cyclone separators are so large, though, that the low velocity air moving through them cannot lift the fine material back up to the classifying zone of the cyclone separator.

Thus, there has been evidenced in the prior art a need for a new and improved form of mechanical air separator which will embody a mode of operation whereby the causes of bypassing enumerated hereinabove would either be entirely obviated or at a minimum significantly reduced such that the efficiency of the mechanical air separator would be measurably improved. Namely, a need has been evidenced for a new and improved form of mechanical air separator that would enable one to realize through the use thereof economies in power consumption in the grinding circuit and steeper particle size distribution in the finished product. That is, a new and improved form of mechanical air separator has been sought which would be operative to reduce the specific horsepower requirements of the grinding circuit thereby enabling the circuit to be operated at higher capacity as well as permitting increased flow of air through the device and even in some instances the elimination of the need for water sprays and cement coolers to effect cooling. In addition, there has been sought such a mechanical air separator which is further characterized in that the effectiveness of particle size separation achievable therewith is such that it is possible to realize much higher fineness at the present Blaine and thereby higher cement strengths than would normally result at the same Blaine.

It is, therefore, an object of the present invention to provide a new and improved high efficiency separator system that is operative both to grind material and to thereafter separate the ground material into a finished product which contains particles that are of a predetermined size.

It is another object of the present invention to provide such a new and improved high efficiency separator system that includes a grinding device in which the material is ground and a new and improved high efficiency mechanical air separator in which the classification of the ground material into a finished product is accomplished.

It is still another object of the present invention to provide such a new and improved high efficiency separator in which all of the air vented from the grinding device is fed directly to the high efficiency mechanical air separator thereby effectuating the removal from the grinding device of material that has been ground to an acceptable fineness which if not otherwise removed would continue to undergo grinding needlessly in the grinding device.

A further object of the present invention is to provide such a new and improved high efficiency separator system wherein a characteristic of the high efficiency mechanical air separator that is employed therein is that air is passed through the high efficiency mechanical air separator only once thereby preventing the internal recirculation of fines therethrough, which has been identified to be a cause of bypass.

A still further object of the present invention is to provide such a new and improved high efficiency separator system wherein a characteristic of the new and improved high efficiency mechancial air separator that is employed therein is that the flow of air therethrough is controlled so that a high velocity mixing zone is established therein whereby excellent mixing of the air and feed material is achieved prior to the feed material reaching the classifying zone within the high efficiency mechanical air separator thus ensuring the avoidance of inadequate dispersion of the feed material in the air, which has been identified to be a cause of bypass.

Yet another object of the present invention is to provide such a new and improved high efficiency separator system wherein a characteristic of the new and improved high efficiency mechanical air separator that is employed therein is that a maximum limit is established for the material/air ratio employed therewith in an effort to prevent the occurrence of interference between particles in the classifying zone of the high efficiency mechanical air separator, which has been identified to be a cause of bypass.

Yet still another object of the present invention is to provide such a new and improved high efficiency separator system which is characterized in that through the use thereof economies in power consumption in the grinding circuit are capable of being realized and a steeper particle size distribution in the finished product is capable of being achieved.

Yet still a further object of the present invention is to provide such a new and improved high efficiency separator system wherein a characteristic of the new and improved high efficiency mechanical air separator that is employed therein is that the latter is suitable for use both in new applications and in retrofit applications.

SUMMARY OF THE INVENTION

In accordance with one aspect of the present invention, there is provided a new and improved high efficiency separator system that is operative both to grind material and to thereafter separate the ground material into a finished product which contains particles that are of a predetermined size. The subject high efficiency separator system includes grinding means, high efficiency separator means, dust collector means and fan means all of which are interconnected in a predefined flow path. More specifically, the grinding means of the subject high efficiency separator system includes inlet means through which the material to be ground therewithin is fed thereto, a first outlet means through which the air vented from the grinding means exits therefrom, and a second outlet means through which the material ground within the grinding means exits therefrom. The high efficiency separator means of the subject high efficiency separator system includes a first inlet means connected in flow relation with the second outlet means of the grinding means and through which the material ground in the grinding means is made to enter the high efficiency separator means, a second inlet means connected in flow relation with the first outlet means of the grinding means for receiving from the grinding means the air vented therefrom as well as any makeup air that may be deemed to be required, a first outlet means through which the product being vented from the high efficiency separator means exits therefrom, and a second outlet means connected in flow relation with the inlet means of the grinding means and through which the tailings are discharged from the high efficiency separator means and recirculated to the grinding means. The dust collector means includes inlet means connected in flow relation with the first outlet means of the high efficiency separator means through which the product vented from the high efficiency separator means is fed to the dust collector means, a first outlet means through which ground material embodying particles of the desired size is discharged as finished product from the dust collector means and thus concomitantly from the subject high efficiency separator system, and a second outlet means which is connected in flow relation with the fan means.

In accordance with another aspect of the present invention, there is provided a new and improved high efficiency mechanical air separator that is operative to effectuate a very sharp classification cut of the feed material receive thereby such that the tailings discharged therefrom contain very little, if any, acceptable finished product therewithin. The subject high efficiency mechanical air separator includes housing means, a feed material inlet means formed in the upper portion of the housing means, a distributor plate means supported for rotation within the housing means and so as to be positioned in alignment with the feed material inlet means, an air inlet means formed in the lower portion of the housing means, and whizzer blade means rotatably supported within the housing means downstream of the location whereat air enters the subject mechanical air separator means through the air inlet means. The mode of operation of the subject high efficiency mechanical air separator is such that feed material enters through the feed material inlet means and under the influence of gravity drops upon the distributor plate means. Concomitantly therewith air enters through the air inlet means and flows in an upwardly direction within the housing means in once through fashion. In doing so the air is made to flow upwardly through the annular space defined by the periphery of the distributor plate means and the inner wall surface of the housing means. As the air flows through this annular space surrounding the periphery of the distributor plate means a high velocity mixing zone is established thereat such that the feed material upon striking the distributor plate means and being thrown outwardly thereof under the influence of centrifugal force becomes entrained in the upwardly flow of air whereby by virtue of the excellent mixing of the air and feed material that is achieved very little, if any, of the feed material fails to become entrained in the upwardly moving flow of air. Thereafter, the stream of air and feed material is made to pass through the whizzer blade means during the course of which the feed material undergoes classification such that the finer feed material passes through the whizzer blade means and is made to exit from the subject high efficiency mechanical air separator through a first outlet means which is suitably formed in the upper portion of the housing means, whereas the coarser feed material is rejected by, i.e., fails to pass through, the whizzer blade means and is made to exit from the subject high efficiency mechanical air separator through a tailings spout with which the latter is suitably provided in the lower portion of the housing means.

DESCRIPTION OF A PREFERRED EMBODIMENT

Figure 1:
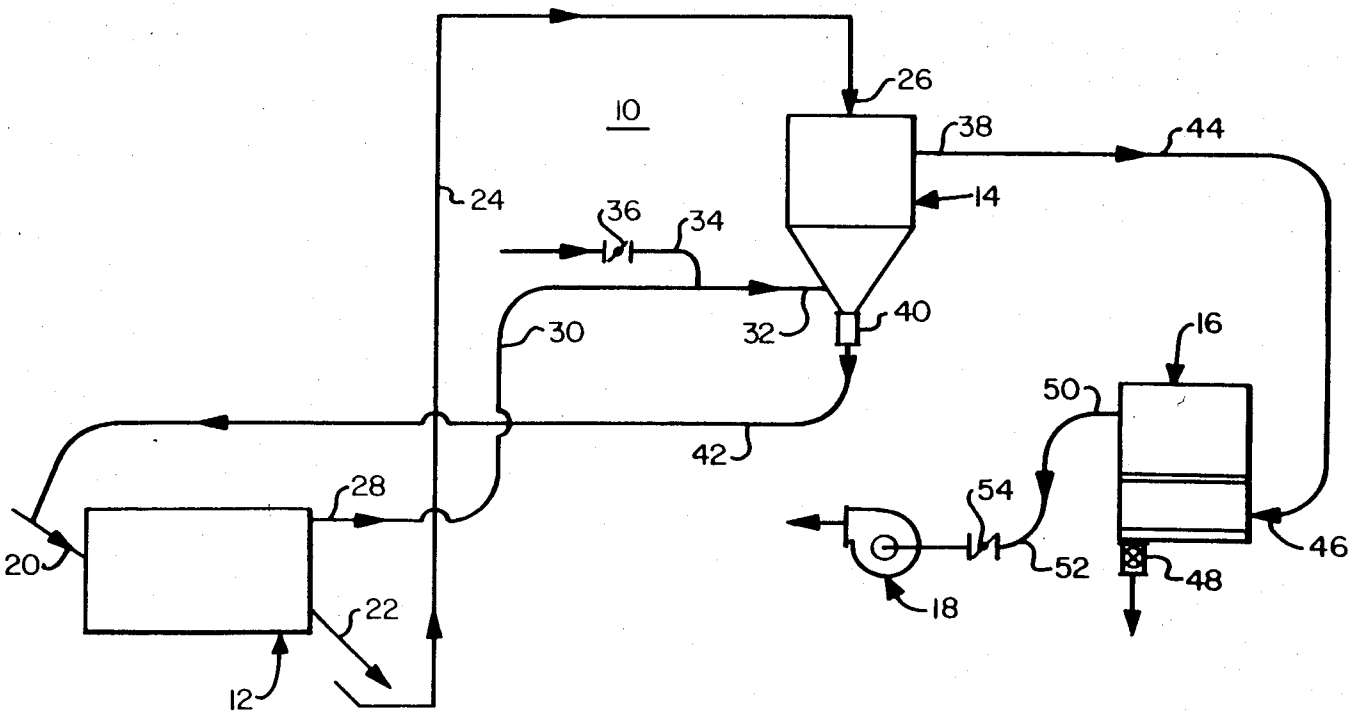
FIG. 1 is a schematic diagram of a high efficiency separator system, constructed in accordance with the present invention.

Referring now to the drawing, and in particular to FIG. 1 thereof, there is illustrated therein a high efficiency separator system, generally designated by the reference numeral 10, constructed in accordance with the present invention. More specifically, there is depicted in FIG. 1 a high efficiency separator system 10 that includes a grinding means, generally designated by the reference numeral 12; a high efficiency separator means, generally designated by the reference numeral 14, and the nature of the construction and the mode of operation of which represents another aspect of inventive subject matter in accordance with the present invention; a dust collector means, generally designated by the reference numeral 16; and a fan means, generally designated by the reference numeral 18. Moreover, in accordance with the present invention the grinding means 12, the high efficiency separator means 14, the dust collector means 16 and the fan means 18 are all interconnected one to another in such a manner so as to define a predetermined flow path to which further reference will be had hereinafter.

Continuing with the description of the high efficiency separator system 10 of FIG. 1, the latter is designed to be operative both to grind material and to thereafter separate the ground material into a finished product which embodies particles that are of a predetermined size. To this end, the mode of operation of the high efficiency separator system 10 of FIG. 1, simply stated, is such that material which is to be ground is fed to the grinding means 12 wherein the material undergoes grinding. After being ground in the grinding means 12, the material is fed in the form of feed material to the high efficiency separator means 14. Within the high efficiency separator means 14, a separation is had of the finer feed material from the coarser feed material. Thereafter, the finer feed material is fed on to the dust collector means 16 and ultimately is discharged therefrom as finished product which embodies particles that are of a predetermined size. The coarser feed material, on the other hand, is recirculated from the high efficiency separator means 14 to the grinding means 12 for additional grinding.

In accord with the teachings of the present invention, the grinding means 12 may take the form of any suitable conventional form of grinding device that is commonly found utilized for purposes of effecting the grinding of solid materials such as cement. By way of exemplification, reference is had here to such grinding devices as ball mills of the type that are manufactured by many manufacturers. Since the nature of the construction as well as the mode of operation of such ball mills is well-known to those skilled in the art of the grinding of materials, it is not deemed necessary to set forth a detailed description thereof herein or to include an illustration thereof in the drawing. Rather, it is deemed sufficient for purposes of obtaining an understanding of the subject matter of the present invention to simply note herein that the function of the grinding means 12 is to effect the grinding of the solid material such as cement that is fed thereto. In view of the fact that the high efficiency separator system 10 is particularly suited for use in processing a material such as cement, for purposes of the discussion that follows hereinafter of the nature of the construction and the mode of operation of the high efficiency separator system 10 as well as that of the high efficiency separator means 14, the solid material which is processed therewithin will be deemed to be cement. To this end, cement in the required quantity and at the required rate is supplied from a suitable source of supply thereof (not shown) to the grinding means 12 by any suitable sort of transport means, the latter being operable to effect an interconnection of the supply source (not shown) of cement with the inlet means, denoted in FIG. 1 by the reference numeral 20, of the grinding means 12.

For purposes of accomplishing the grinding thereof within the grinding means 12, the cement is conveyed therethrough by means of a flow of gas. This gas, which preferably is air, is supplied through any suitable conventional means to the grinding means 12. In accord with the illustration of FIG. 1 of the drawing, the air, which is employed in the conveyance of the cement through the grinding means 12, is fed to the grinding means 12 through conduit means (not shown) such that the air is made to enter the grinding means 12 through the inlet means that has been denoted in FIG. 1 of the drawing by means of the reference numeral 20.

After being ground in the grinding means 12, the cement is discharged therefrom through the outlet means that has been denoted in FIG. 1 by the reference numeral 22. Upon being so discharged from the grinding means 12 through the outlet means 22 thereof, the cement is transported to the high efficiency separator means 14 through the use of any suitable form of conventional transport means, the latter being schematically illustrated in FIG. 1 wherein the transport means has been identified by the reference numeral 24. One form that the transport means 24 can take is that of a bucket elevator. On reaching the high efficiency separator means 14, the cement is made to enter the latter through inlet means, seen at 26 in FIG. 1, with which the high efficiency separator means 14 is suitably provided for this purpose. Note is made here of the fact that the inlet means 26 is located at the top of the high efficiency separator means 14. The significance of the location of the inlet means 26 will become more readily apparent as a discussion is had hereinafter of the nature of the construction and the mode of operation of the high efficiency separator means 14, which is to be found illustrated in more detail in FIGS. 2 and 3 of the drawing.

With further reference to the grinding means 12, the latter as can be seen with reference to FIG. 1 of the drawing is provided with a second outlet means, the latter being denoted in FIG. 1 by the reference numeral 28. It is through this second outlet means 28 that the air which has been employed for purposes of effectuating the conveyance of the cement through the grinding means 12 is vented therefrom. Upon being vented from the grinding means 12 through the outlet means 28, the vented air is supplied to the high efficiency separator means 14 through the use of any conventional form of conveyance means that is suitable for use for such a purpose. This conveyance means can be found illustrated in FIG. 1 of the drawing wherein the conveyance means is identified by the reference numeral 30. This air which is vented from the grinding means 12 through the outlet means 28 commonly has entrained therewithin fine particles. In accord with the mode of operation of the high efficiency separator system 10 of the present invention constructed as illustrated in FIG. 1 of the drawing, no attempt is made to separate these fine particles from the air vented from the grinding means 12 prior to the vented air reaching the high efficiency separator means 14.

At the high efficiency separator means 14 the air vented from the grinding means 12 is made to enter the high efficiency separator means 14 through a second inlet means, seen at 32 in FIG. 1, with which the high efficiency separator means 14 is suitably provided. As in the case of the inlet means 26, note is also made here of the location of the inlet means 32 which as can be seen with reference to FIG. 1 of the drawing is located in the lower section of the high efficiency separator means 14. The significance of this location will become clearer from the description of the nature of the construction and the mode of operation of the high efficiency separator means 14 which can be found set forth hereinafter in connection with a discussion of FIGS. 2 and 3 of the drawing. Finally, for purposes of accomplishing the classification within the high efficiency separator means 14 of the cement that enters the latter through the inlet means 26, there may be a need to increase the amount of air flow through the high efficiency separator means 14. That is, the amount of vented air supplied to the high efficiency separator means 14 from the grinding means 12 may be insufficient to accomplish the aforereferenced classification of the cement within the high efficiency separator means 14. To this end, the air vented from the grinding means 12 may be augmented by makeup air. More specifically, such makeup air may be introduced into the conveyance means 30 through the conduit means which is schematically illustrated in FIG. 1, and which can be found denoted in FIG. 1 by the reference numeral 34. Moreover, in order to control the amount of makeup air which is supplied for this purpose, the conduit means 34 is preferably provided by valve means, the latter being identified in FIG. 1 by the reference numeral 36. The valve means 36 may take the form of any conventional form of valve means that is suitable for use for such a purpose.

Moving on next to a consideration of the mode of operation of the high efficiency separator means 14, as described previously hereinbefore the feed material, e.g., cement, that has been ground in the grinding means 12 enters the high efficiency separator means 14 through the inlet means 26. After entering the high efficiency separator means 14 through the inlet means 26, the cement, in a manner which will be more fully described hereinafter, is caused to flow to a high velocity mixing zone within the high efficiency separator means 14. Concomitantly therewith, the air which enters the high efficiency separator means 14 through the inlet means 32, in a manner which will be described more fully hereinafter, is also caused to flow to the aforereferenced high velocity mixing zone. Within this high velocity mixing zone the particles of cement become entrained in the flow of air. A very important characteristic of this mixing zone with which the high efficiency separator means 14 is provided in a manner yet to be described is that by virtue of the flow of high velocity air therethrough an excellent mixture of air and cement particles is achieved such that very little, if any, of the cement particles fail to become entrained in the flow of air thereby minimizing the likelihood that bypass occasioned by the inadequate dispersion of the cement particles in the air flow will occur. Thereafter, the combined stream of air and cement particles is made to flow in a manner that will be described hereinafter to the classifying zone of the high efficiency separator means 14. As will be described subsequently in connection with the discussion of FIGS. 2 and 3 of the drawing, within the classification zone of the high efficiency separator means 14 a classification is had of the stream of air and cement particles such that the cement particles which are of the desired particle size while still entrained within the stream of air are caused to be discharged along with the stream of air through the outlet means with which, as schematically illustrated at 38 in FIG. 1, the high efficiency separator means 14 is suitably provided. The coarser particles of cement, i.e., those which are not of the desired particle size, are caused to be discharged from the high efficiency separator means 14 through a tailings spout with which the high efficiency separator means 14 is suitably provided and which preferably terminates in a double flap valve, the latter being denoted in FIG. 1 of the drawing by the reference numeral 40. In known fashion, the double flap valve 40 is operative as the means by which the coarser cement particles, i.e., tailings, are allowed to discharge from the high efficiency separator means 14 while allowing a minimal amount of infiltrating air to enter the unit.

From the high efficiency separator means 14, the tailings, as will be best understood with reference to FIG. 1 of the drawing, are recirculated back to the grinding means 12 for further reduction. More specifically, the tailings from the high efficiency separator means 14, after being made to pass through the double flap valve 40, are conveyed by means of any conventional form of conveyance means, the latter being schematically illustrated in FIG. 1 of the drawing wherein the conveyance means can be found identified by the reference numeral 42, that is suitable for use for such a purpose. As seen with reference to FIG. 1 of the drawing, the tailings that are recirculated by means of conveyance means 42 from the high efficiency separator means 14 to the grinding means 12 are made to enter the latter through inlet means 20 to which reference has herein previously been had. Within the grinding means 12, the tailings in known fashion are subjected to additional grinding whereupon after being reground the tailings are discharged from the grinding means 12 through the outlet means 22 and once again are fed back to the high efficiency separator means 14 wherein in the manner to which reference has previously been had herein there is effectuated a classification of the ground material into that which is comprised of particles of the desired size and that which is comprised of particles that exceed the desired size.

Continuing with the description of the high efficiency separator means 14, the fine particles while still entrained in the air stream exit from the high efficiency separator means 14 through the outlet means 38 and are transported to the dust collector means 16 by means of any conventional form of transport means, the latter being schematically depicted in FIG. 1 wherein the designation thereof has been had by means of the reference numeral 44, that is suitable for use for the aforedescribed purpose. Upon reaching the dust collector means 16, the combined stream of air and fine particles enters the dust collector means 16 through an inlet means, denoted in FIG. 1 of the drawing by the reference numeral 46, with which the dust collector means 16 is suitably provided for this purpose.

With further regard to the dust collector means 16, the latter is designed to be operative to accomplish in known fashion the separation of the fine particles from the stream of air. In accord with the teachings of the present invention, the dust collector means 16 may take the form of any suitable conventional form of dust collector device that is commonly found employed for purposes of effectuating the separation of fine particles from a gaseous stream. Since the nature of the construction as well as the mode of operation of such dust collector devices is well-known to those skilled in the art, it is not deemed necessary to set forth a detailed description thereof herein or to include an illustration thereof in the drawing. Rather, it is deemed sufficient for purposes of obtaining an understanding of the subject matter of the present invention to simply note herein that the function of the dust collector means 16 is to cause in known fashion a separation to be had from the air stream of the fine particles that are entrained therewithin. Thereafter, the fine particles, which in accordance with the description that has been set forth hereinbefore of the high efficiency separator system 10 constitute cement particles, are discharged from the dust collector means 16 in the form of finished product through an outlet means with which the dust collector means 16 is suitably provided and which in accord with the present invention terminates in valve means, the latter being identified in FIG. 1 by the reference numeral 48. The valve means 48 may take the form of any conventional type of valve means that is known to be capable of being employed for the aforedescribed purpose. In accord with the illustrated embodiment of the high efficiency separator system 10 the valve means 48 is designed to be operative to control the rate at which the finished product is discharged from the dust collector means 16 and concomitantly from the high efficiency separator system 10.

The air which remains after the fine particles are removed therefrom is discharged from the dust collector means 16 through an outlet means, denoted in FIG. 1 by the reference numeral 50 with which the dust collector means 16 is suitably provided for this purpose. Moreover, in known fashion this air upon being discharged from the dust collector means 16 is drawn, i.e., caused to be conveyed, therefrom by virtue of the action of the fan means 18. More specifically, the outlet means 50 of the dust collector means 16 is interconnected with the fan means 18 by means of conduit means, the latter being schematically shown in FIG. 1 of the drawing wherein the conduit means has been identified by the reference numeral 52. The conduit means 52 may take the form of any conventional type of conduit means that is suitable for use for such a purpose. In accord with the illustrated embodiment of the high efficiency separator system 10 of the present invention, there is preferably employed along the length of the conduit means 52 suitable valve means, the latter being depicted at 54 in FIG. 1 of the drawing, such as to be located in interposed relation between the dust collector means 16 and the fan means 18. The fan means 18 may take the form of any conventional type of fan device that is capable of being employed as a system fan in a system of the type depicted in FIG. 1. Inasmuch as such fan devices are well-known to those skilled in the art, it has not been deemed necessary to include herein for purposes of acquiring an understanding of the high efficiency separator system 10 of the present invention a detailed description of the nature of the construction as well as the mode of operation of the fan means 18 or to include an illustration of the same in the drawing.

To thus summarize, the high efficiency separator system 10 of the present invention and as found illustrated in FIG. 1 of the drawing includes grinding means 12, high efficiency separator means 14, dust collector means 16 and fan means 18 all of which are interconnected in a predefined flow path. Moreover, the grinding means 12 of the subject high efficiency separator system 10 includes inlet means 20 through which the material to be ground therewithin is fed thereto, a first outlet means 28 through which the air vented from the grinding means 12 exits therefrom, and a second outlet means 22 through which the material ground within the grinding means 12 exits therefrom. The high efficiency separator means 14 of the subject high efficiency separator system 10 includes a first inlet means 26 connected in flow relation with the second outlet means 22 of the grinding means 12 and through which the material ground in the grinding means 12 is made to enter the high efficiency separator means 14, a second inlet means 32 connected in flow relation with a first outlet means 28 of the grinding means 12 for receiving from the grinding means 12 the air vented therefrom as well as any makeup air that may be deemed to be required, a first outlet means 38 through which the product being vented from the high efficiency separator means 14 exits therefrom, and a second outlet means terminating in a double flap valve 40 connected in flow relation with the inlet means 20 of the grinding means 12 and through which the tailings are discharged from the high efficiency separator means 14 and recirculated to the grinding means 12. The dust collector means 16 includes inlet means 46 connected in flow relation with the first outlet means 38 of the high efficiency separator means 14 through which the product vented from the high efficiency separator means 14 is fed to the dust collector means 16, a first outlet means terminating in valve means 48 through which ground material embodying particles of the desired size is discharged as finished product from the dust collector means 14 and thus concomitantly from the subject high efficiency separator system 10, and a second outlet means 50 which is connected in flow relation with the fan means 18, the latter being designed to be operative as a system fan.

Figure 2:
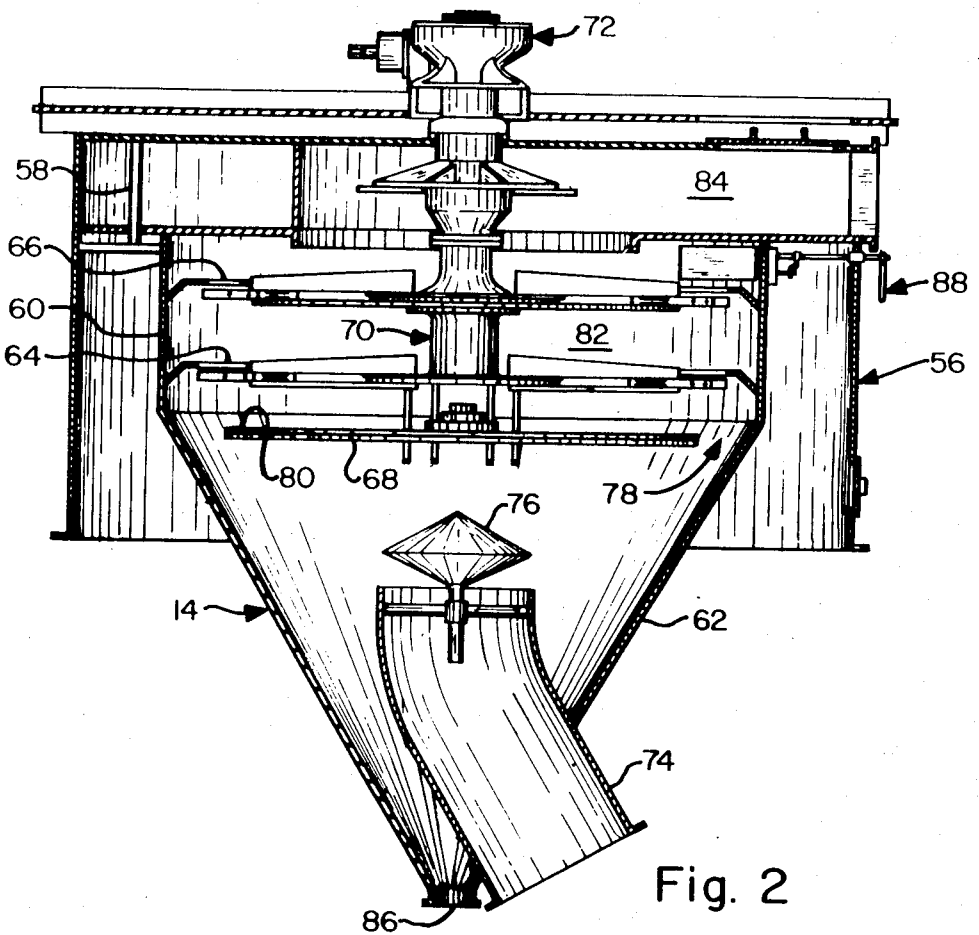
FIG. 2 is a cross-sectional view of a high efficiency mechanical air separator, constructed in accordance with the present invention, which is particularly suited for employment in the high efficiency separator system illustrated in FIG. 1.
Figure 3:
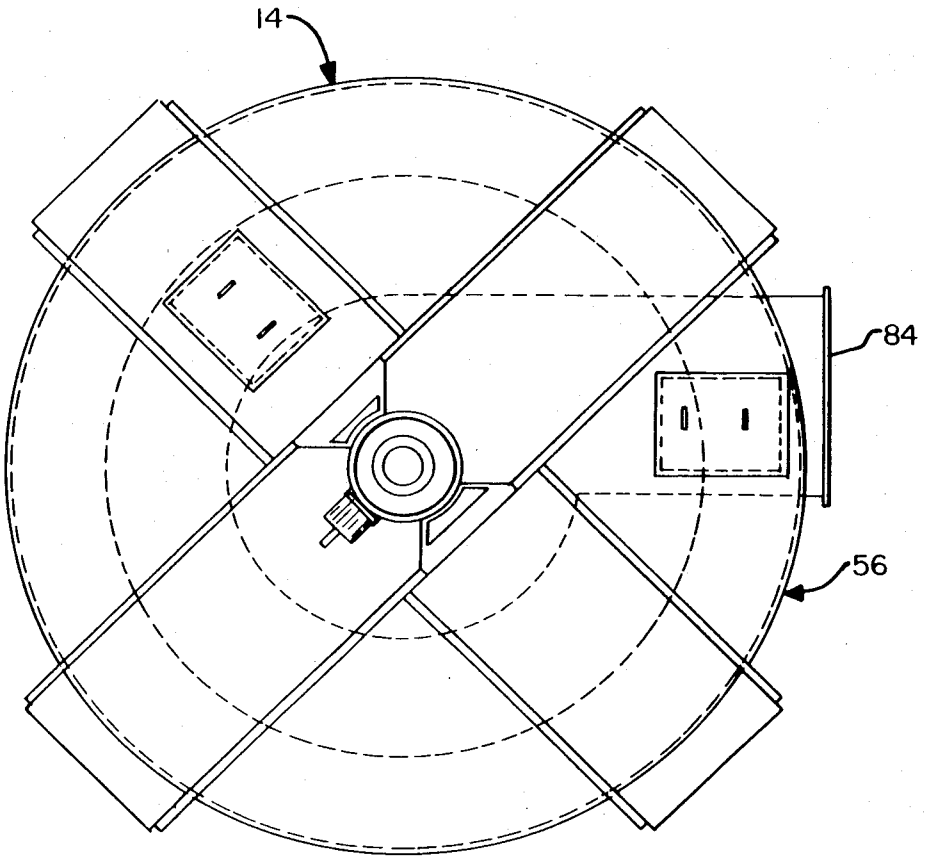
FIG. 3 is a top plan view of the high efficiency mechanical air separator of FIG. 2, constructed in accordance with the present invention.

With reference in particular to FIGS. 2 and 3 of the drawing, a description will now be set forth of the nature of the construction and the mode of operation of the high efficiency separator means 14 which comprises another aspect of the inventive subject matter of the present invention. More specifically, the high efficiency separator means 14 comprises a new and improved form of high efficiency mechanical air separator. For ease of reference in connection with the description that follows hereinafter of the high efficiency separator means 14, the same reference numerals which have been employed in FIG. 1 of the drawing for purposes of identifying various features of a structural nature that the high efficiency separator means 14 embodies have also been utilized to designate these same features in FIGS. 2 and 3 of the drawing to the extent that they appear as well therein. The high efficiency separator means 14 constructed in accordance with the present invention includes a housing means, the latter being denoted generally in FIGS. 2 and 3 by the reference numeral 56. As best understood with the reference to both FIGS. 2 and 3 of the drawing, the housing means 56 embodies a generally cylindrical configuration. Moreover, the housing means 56, as seen with reference to FIG. 2, has suitably formed therewithin for purposes yet to be described both an outer drum, the latter being denoted in FIG. 2 by the reference numeral 58, and an inner drum, the latter being denoted by the reference numeral 60 in FIG. 2. Cooperatively associated with the inner drum 60 as shown in FIG. 2 is in turn a lower cone which is identified in FIG. 2 by the reference numeral 62.

Continuing with the description of the high efficiency separator means 14 constructed as shown in FIGS. 2 and 3 of the drawing, a pair of whizzer blades, seen in FIG. 2 at 64 and 66, are suitably mounted within the inner drum 60 for rotation therewithin. Further, cooperatively associated with the whizzer blades 64 and 66 is a distributor plate, the latter being identified in FIG. 2 by the reference numeral 68. More specifically, the distributor plate 68 is suitably supported for rotation approximately at the location whereat the lower cone 62 is joined to the inner drum 60.

Any conventional form of motor drive means that is capable of being employed to impart rotation to disc-like members may, without departing from the essence of the present invention, be utilized for purposes of imparting to the whizzer blades 64 and 66 as well as the distributor plate 68 the rotation which it is desired to have these members undergo. In accord, however, with the embodiment of the high efficiency separator means 14 illustrated in the drawing, the whizzer blades 64 and 66 are each suitably supported from a tube-like structure, the latter being denoted generally by the reference numeral 70 in FIG. 2. The distributor plate 68, on the other hand, is suitably supported from the whizzer blade 64 through the use of any conventional form of support means such as to be rotatable with the whizzer blade 64. In turn, the tube-like structure 70 is rotatably driven by motor means, the latter being identified generally in FIG. 2 by the reference numeral 72.

With further regard to the tube-like structure 70, the latter is designed to be operative in the manner of a feed pipe. As such, the tube-like structure 70 may be viewed as comprising the inlet means 26 of the high efficiency separator means 14 to which reference has been had hereinbefore in connection with the description of the nature of the construction and the mode of operation of the high efficiency separator system 10, which is to be found illustrated in FIG. 1 of the drawing. That is, the tube-like structure 70 is provided with a hollow interior, and it is through the hollow interior of the tube-like structure 70 that the material, which for purposes of the present discussion has been deemed to be cement, ground in the grinding means 12 of the high efficiency separator system 10 enters the housing means 56 of the high efficiency separator means 14. After entering the tube-like structure 70, and more specifically the hollow interior thereof, the feed material falls the length of the tube-like structure 70 under the influence of gravity and drops onto the distributor plate 68. Mention is made here of the fact that the tube-like structure 70 terminates at a point which is located approximately within the plane defined by the whizzer blade 64, which in turn is suitably spaced as seen with reference to FIG. 2 from the plane defined by the distributor plate 68. As such feed material upon leaving the tube-like structure 70 is caused to be dispersed upon the distributor plate 68, which as has been noted previously herein is undergoing rotation.

As the feed material enters the tube-like structure 70, air is also entering the air inlet, seen at 74 in FIG. 2, with which the high efficiency separator means 14 is suitably provided. To this end, the air inlet 74 may be viewed as constituting the inlet means 32 to which reference has been had hereinbefore in connection with the description of the high efficiency separator means 14 which is employed in the high efficiency separator system 10 that is shown in FIG. 1 of the drawing. In accord with the embodiment of the high efficiency separator means 14 illustrated in FIG. 2, an air diffuser seen at 76 in FIG. 2, is preferably mounted through the use of any conventional form of support means at the downstream terminus of the air inlet 74. The air diffuser 76 in turn is designed to be operative to effect for a purpose to be described subsequently a diffusion of the air as the air exits from the air inlet 74.

After undergoing diffusion by the air diffuser 76, the air continues to flow in an upwardly direction within the housing means 56 of the high efficiency separator means 14 until it reaches a high velocity mixing zone, the latter being denoted in FIG. 2 of the drawing by the reference numeral 78. It is within this high velocity mixing zone 78 that the feed material dropping on to the rotating distributor plate 68 becomes entrained in the air flow in a manner to which further reference will be had hereinafter. Suffice it to say at this point, however, that the existence of the high velocity mixing zone 78 within the high efficiency separator means 14 serves to advantageously characterize the operation of the high efficiency separator means 14 by virtue of the fact that one of the known causes of bypass is virtually eliminated thereby. The high velocity mixing zone 78 to which reference is had here is definable as being the area that surrounds the periphery of the distributor plate 68, i.e., that exists between the periphery of the distributor plate 68 and the inner wall surface of the lower cone 62. More specifically, the high velocity mixing zone 78 is the area which exists around the periphery of the wear liner, the latter being identified in FIG. 2 of the drawing by the reference numeral 80. The wear liner 80 is suitably supported on the upper surface, as viewed with reference to FIG. 2, of the distributor plate 68. The wear liner 80 is designed to be operative to absorb the wear to which the distributor plate 68 would otherwise be subjected a a consequence of the feed material striking the distributor plate 68 after leaving the tube-like structure 70. As a final note mention is made here of the fact that to the extent that the feed material which drops on to the wear liner 80 and is thrown outwardly thereof under the influence of centrifugal force does not become entrained in the air flowing upwardly through the high velocity mixing zone 78, the feed material drops downwardly under the influence of gravity along the inner wall surface of the lower cone 62, and is discharged therefrom in a manner which will be described subsequently. With feed material now entrained therein, the air next passes through the classifying zone, the latter being denoted generally in FIG. 2 of the drawing by the reference numeral 82, of the high efficiency separator means 14. The classifying zone 82 to which reference is had here comprises that portion of the high efficiency separator means 14 in which the whizzer blades 64 and 66 are operative. The mode of operation of the whizzer blades 64 and 66 is such that as the air passes therethrough the particles that are entrained therein and which are of the desired size also pass therethrough into the air outlet, i.e., the area that is denoted in FIG. 2 by the reference numeral 84. On the other hand, those particles entrained in the air which are not of the desired size are prevented from passing through the classifying zone 82 by virtue of the action of the whizzer blades 64 and 66. More specifically, those particles which exceed the desired size are separated from the air by the action of the whizzer blades 64 and 66, and are caused to fall under the influence of gravity in a downwardly direction along the inner wall surface of the lower cone 62, whereupon these particles, commonly referred to as the tailings, join with those particles, to the extent that there may be any, which never became entrained in the air as the latter flowed through the high velocity mixing zone 78. The tailings, in known fashion, are discharged from the high efficiency separator means 14 and more specifically from the tailings spout with which the high efficiency separator means 14 is suitably provided and which in accord with the illustration of the high efficiency separator system 10 of FIG. 1 terminates in a double flap valve 40 to which reference has previously been had hereinbefore. To this end, the discharge port, which may be seen at 86 in FIG. 2, formed at the lower end, as viewed with reference to FIG. 2, of the lower cone 62 may be deemed to be the outlet means to which reference has been had hereinbefore in connection with the description of the high efficiency separator system 10 with which the high efficiency separator means 14 that is utilized in the high efficiency separator system 10 is suitably provided. On the other hand, those particles of feed material which are of the desired size remain entrained in the air and are discharged with the air through the air outlet seen at 84 in FIG. 2. In accord with the illustration of the high efficiency separator means 14 which is employed in the high efficiency separator system 10 of FIG. 1 the air outlet 84 may be viewed as comprising the outlet means that is denoted by the reference numeral 38 in FIG. 1.

For purposes of completing the description of the nature of the construction thereof, reference is had here to the fact that the high efficiency separator means 14 constructed as shown in the various figures of the drawing preferably is made to embody a vertical swing damper fineness adjustment means, the latter being best seen with reference to FIG. 2 wherein the vertical swing damper fineness adjustment means is designated generally by the reference numeral 88. The vertical swing damper fineness adjustment means 88 is designed to be employed for purposes of achieving fineness control. To this end, the mode of operation of the vertical swing damper adjustment fineness means 88 is such that the latter operates to straighten the rotating air vortex that is present within the housing means 56 of the high efficiency separator means 14, thus affecting classification without reducing the air flow. As such, unlike with other forms of adjustment means it is possible with the vertical swing damper fineness adjustment means 88 to effect the aforedescribed adjustment, i.e., fineness control, while yet maintaining the classification efficiency of the high efficiency separator means 14.

By way of a summary, it should thus be readily apparent that the high efficiency separator means 14 comprises a new and improved form of mechanical air separator that is operative to effectuate a very sharp classification cut of the feed material received thereby such that the tailings discharged therefrom contain very little, if any, acceptable finished product therewithin. This has been accomplished by providing a high efficiency separator means 14 that is constructed in such a manner that the high efficiency separator means 14 does not suffer from the three causes of bypass that can be found enumerated at the outset of the instant application. Namely, the high efficiency separator means 14 is characterized by a mode of operation wherein a once through flow of air occurs therewithin. As such, there is no possibility for a recirculation through the high efficiency separator means 14 of air in which fine particles might be entrained. Secondly, the high efficiency separator means 14 is characterized by the presence therewithin of a high velocity mixing zone in which the high velocity of the air flowing therethrough gives rise to an excellent mixing of the feed material particles therewith such that very little, if any, of the feed material particles fail to become entrained in the air. Lastly, by effecting control over the feed material to air ratio which commonly is expressed in terms of the feed material rate to air flow rate ratio so as to limit the amount of feed material that is being fed to the high efficiency separator means 14, it has been found possible to prevent the occurrence of bypass that is occasioned by the interference that might otherwise take place between particles within the classifying zone 82 of the high efficiency separator means 14. In this regard, in setting the maximum limit for the feed material/air ratio recognition should be had of the fact that consideration may need to be taken with respect to the particular type of feed material which is to be supplied to the high efficiency separator means 14. The subject high efficiency mechanical air separator 14 includes housing means 56, a feed material inlet means 70 formed in the upper portion of the housing means 56, a distributor plate means 68 supported for rotation within the housing means 56 and so as to be positioned in alignment with the feed material inlet means 70, an air inlet means 74 formed in the lower portion of the housing means 56, and whizzer blade means 64 and 66 rotatably supported within the housing means 56 downstream of the location whereat air enters the subject mechanical air separator 14 through the air inlet means 74. The mode of operation of the subject high efficiency mechanical air separator 14 is such that feed material enters through the feed material inlet means 70 and under the influence of gravity drops upon the distributor plate means 68. Concomitantly therewith air enters through the air inlet means 74 and flows in an upwardly direction within the housing means 56 in once through fashion. In doing so the air is made to flow upwardly through the annular space defined by the periphery of the distributor plate means 68 and the inner wall surface of the lower cone 62. As the air flows through this annular space surrounding the periphery of the distributor plate means 68 a high velocity mixing zone 78 is established thereat such that the feed material upon striking the distributor plate means 68 and being thrown outwardly thereof under the influence of centrifugal force becomes entrained in the upwardly flow of air whereby by virtue of the excellent mixing of the air and feed material that is achieved very little, if any, of the feed material fails to become entrained in the upwardly moving flow of air. Thereafter, the stream of air and feed material is made to pass through the whizzer blade means 64 and 66 during the course of which the feed material undergoes classification such that the finer feed material passes through the whizzer blade means 64 and 66 and is made to exit from the subject high efficiency mechanical air separator through a first outlet means 84 which is suitably formed in the upper portion of the housing means 56, whereas the coarser feed material is rejected by, i.e., fails to pass through, the whizzer blade means 64 and 66 and is made to exit from the subject high efficiency mechanical air separator 14 through a discharge spout 86 with which the latter is suitably provided in the lower portion of the housing means 56.

There has, therefore, been provided in accordance with the present invention a new and improved high efficiency separator system that is operative both to grind material and to thereafter separate the ground material into a finished product which contains particles that are of the predetermined size. Moreover, the subject high efficiency separator system of the present invention includes a grinding device in which the material is ground and a new and improved high efficiency mechanical air separator in which the classification of the ground material into a finished product is accomplished. In addition, in accord with the present invention a high efficiency separator system is provided in which all of the air vented from the grinding device is fed directly to the high efficiency mechanical air separator thereby effectuating the removal from the grinding device of material that has been ground to an acceptable fineness which if not otherwise removed would continue to needlessly undergo grinding in the grinding device. Furthermore, the subject high efficiency separator system of the present invention is characterized by the fact that the mechanical air separator which is employed therein has the air passed therethrough only once thereby preventing the internal recirculation of fines therethrough, which has been identified to be a cause of bypass. Additionally, in accord with the present invention a high efficiency separator system is provided wherein a characteristic of the new and improved high efficiency mechanical air separator that is employed therein is that the flow of air therethrough is controlled so that a high velocity mixing zone is established therein whereby excellent mixing of the air and feed material is achieved prior to the feed material reaching the classifying zone within the high efficiency mechanical air separator thus ensuring the avoidance of inadequate dispersion of the feed material in the air, which has been identified to be a cause of bypass. Also, the subject high efficiency separator system of the present invention is characterized by the fact that the mechanical air separator that is employed therein has a maximum limit established for the material/air ratio that is utilized therewith in an effort to prevent the occurrence of interference between particles in the classifying zone of the high efficiency mechanical air separator, which has been identified to be a cause of bypass. Finally, in accord with the present invention a high efficiency separator system is provided which is characterized in that through the use thereof economies in power consumption in the grinding circuit are capable of being realized and a steeper particle size distribution in the finished product is capable of being achieved.

While only one embodiment of my invention has been shown, it will be appreciated that modifications thereto, some of which have been alluded to hereinabove, may still be readily made thereto by those skilled in the art. I, therefore, intend by the appended claims to cover the modifications alluded to herein as well as all other modifications, which fall within the true spirit and scope of my invention.

What is claimed is:

1. A high efficiency separator system operative both to grind material and to separate thereafter the ground material into a finished product comprising:

(a) grinding means operative to effectuate the grinding therewithin of the material fed thereto;

(b) high efficiency separator means connected in flow relation with said grinding means for receiving therefrom all of the material ground in said grinding means as well as all of the air vented from said grinding means, said high efficiency separator means being operative to effectuate therewithin a classification of the ground material supplied thereto from said grinding means and for recirculating in the form of tailings to said grinding means for further reduction therein ground material containing particles exceeding a predetermined particle size, said high efficiency separator means comprising:

(i) housing means including a drum portion and a cone portion, said cone portion having one end thereof joined to one end of said drum portion, (ii) whizzer blade means supported for rotation at a first location within said housing means, said whizzer blade means defining a classification zone within said housing means, said whizzer blade means being operative to effect a classification based on particle size of feed material into a finished product as the feed material entrained in air passes through said classification zone, (iii) a distributor plate means positioned within said housing means at a second location and so as to define between the periphery of said distributor plate means and the internal surface of said housing means an annular passage operative as a high velocity mixing zone, said distributor plate means being supported from said whizzer blade means in spaced relation thereto and so as to be rotatable therewith, said distributor plate means being operative to cause the feed material disposed thereon to be dispersed under the influence of gravity into said high velocity mixing zone, (iv) a feed material inlet means supported in said housing means for supplying feed material on to said distributor plate means, said feed material inlet means being coaxially aligned with said whizzer blade means and having a first end thereof projecting outwardly of said housing means and a second end thereof terminating at a point intermediate said first location of said whizzer blade means and said second location of said distributor plate means, (v) an air inlet means supported in said cone portion for supplying into the interior of said housing means air at a predetermined rate so as to ensure the existence of a predefined material to air ratio within said housing means, said air inlet means having a first end thereof projecting outwardly of said cone portion and a second end thereof terminating at a point spaced from and aligned with said feed material inlet means such that the air exiting from said second end of said air inlet means follows a once-through flow path within said housing means before exiting therefrom and in the course of doing so is made to pass through said high velocity mixing zone at a high velocity so as to effect the entrainment therewithin of the feed material dispersed into said high velocity mixing zone by said distribution plate means, and (vi) discharge means formed in said cone portion of said housing means, said discharge means being operative for effectuating the discharge from said high efficiency separator means of the tailings that remain following the classification within said classification zone of the feed material into finished product by said whizzer blade means;

(c) dust collector means connected in flow relation with said high efficiency separator means for receiving therefrom in the form of finished product entrained in air ground containing particles that are of a predetermined particle size, said dust collector means being operative for separating the ground material particles from: the air and for discharging therefrom as separate entities both the ground material particles in the form of finished product and the air that has had the ground material products removed therefrom; and (d) fan means connected in flow relation with said dust collector means for receiving therefrom the air discharged from said dust collector means.

2. The high efficiency separator system as set forth in claim 1 wherein said grinding means includes inlet means through which the material to be ground therewithin enters said grinding means, a first outlet means through which the air being vented from said grinding means exits therefrom and a second outlet means through which the material ground within said grinding means exits therefrom.

3. The high efficiency separator system as set forth in claim 2 wherein said dust collector means includes inlet means connected in flow relation with said high efficiency separator means through which the finished product vented from said high efficiency separator means is fed to said dust collector means, a first oulet means through which the finished product is discharged from said dust collector means and a second outlet means connected in flow relation with said fan means.

4. A high efficiency mechanical air separator operative for effectuating a classification based on particle size of feed material into a finished product comprising:

(a) housing means including a drum portion and a cone portion, said cone portion having one end thereof joined to one end of said drum portion;

(b) whizzer blade means supported for rotation at a first location within said housing means, said whizzer blade means defining a classification zone within said housing means, said whizzer blade means being operative to effect a classification based on particle size of feed material into a finished product as the feed material entrained in air passes through said classication zone;

(c) a distributor plate means positioned within said housing means at a second location and so as to define between the periphery of said distributor plate means and the internal surface of said housing means an annular passage operative as a high velocity mixing zone, said distributor plate means including a distributor plate supported from said whizzer blade means in spaced relation thereto and so as to be rotatable therewith, said distributor plate being operative to cause the feed material disposed thereon to be dispersed under the influence of gravity into said high velocity mixing zone;

(d) a feed material inlet means supported in said housing means for supplying feed material on to said distributor plate, said feed material inlet means including a tube-like structure coaxially aligned with said whizzer blade means and having a first end thereof projecting outwardly of said housing means and a second end thereof terminating at a point intermediate said first location of said whizzer blade means and said second location of said distributor plate means;

(e) an air inlet means supported in said cone portion for supplying into the interior of said housing means air at a predetermined rate so as to ensure the existence of a predefined material to air ratio within said housing means, said air inlet means having a first end thereof projecting outwardly of said cone portion and a second end thereof terminating at a point spaced from and aligned with said second end of said tube-like structure such that the air exiting from said second end of said air inlet means follows a once-through flow path within said housing means before exiting therefrom and in the course of doing so is made to pass through said high velocity mixing zone at a high velocity so as to effect the entrainment therewithin of the feed material dispersed into said high velocity mixing zone by said distibutor plate means; and (f) discharge means formed in said cone portion of said housing means, said discharge means being operative for effectuating the discharge from the high efficiency mechanical air separator of the tailings that remain following the classisification within said classification zone of the feed material into finished product by said whizzer blade means.

5. The high efficiency mechanical air separator as set forth in claim 4 wherein said whizzer blade means comprises a pair of whizzer blades mounted for rotation within said housing means and so as to be located in spaced relation one to another.

6. The high efficiency mechanical air separator as set forth in claim 5 wherein said housing means further includes an outer drum supported in encircling relation to said drum portion and some of said cone portion of said housing means.

* * * * *